US005387843A

United States Patent [19]

Nagayama et al.

[11] Patent Number: 5,387,843

[45] Date of Patent: Feb. 7, 1995

[54] ION SOURCE HAVING PLASMA CHAMBER, AN ELECTRON SOURCE, AND A PLASMA POWER SUPPLY

[75] Inventors: Takahisa Nagayama; Naomitsu Fujishita; Kazuhiko Noguchi; Hidenobu Murakami, all of Amagasaki, Japan

[73] Assignee: Mitsubishi Denki Kabushiki Kaisha, Tokyo, Japan

[21] Appl. No.: 978,372

[22] Filed: Nov. 18, 1992

[30] Foreign Application Priority Data

Nov. 20, 1991 [JP] Japan ..... 3-304992

[51] Int. Cl.[6] ..... H01J 7/24

[52] U.S. Cl. ..... 315/111.81; 315/111.21; 315/111.31; 313/231.31

[58] Field of Search ..... 315/111.81, 111.21, 315/111.31, 111.41; 313/231.31, 363.1

[56] References Cited

U.S. PATENT DOCUMENTS 4,857,809 8/1989 Torii et al. ..... 315/111.81 X
4,931,698 6/1990 Yoshida ..... 315/111.81
5,089,747 2/1992 Koshiishi et al. ..... 315/111.81

OTHER PUBLICATIONS

"Ion Source Technology", May 31, 1976, Ionics K.K., p. 196.

*Primary Examiner*—Robert J. Pascal
*Assistant Examiner*—Haissa Philogene
*Attorney, Agent, or Firm*—Burns, Doane, Swecker & Mathis

[57] ABSTRACT

The present invention aims to extract a large electron beam and extend the service life of an electron source by effectively radiating an electron beam with low energy from a plasma chamber toward an ion extraction port, and optimally neutralizing space charges of ions in the vicinity of the ion extraction port. An electron source is installed behind a plasma chamber to control an extraction power supply, an electron accelerating power supply, and a lens power supply. Thereby, an electron beam is extracted from the power source, and accelerated. Then, the electron beam is carried through an electric field lens at a high speed, decelerated in the vicinity of the plasma chamber, then converged to radiate toward the ion extraction port. An aperture is installed at a crossover point of the electron beam to diminish backward flow of ionic gas from the plasma chamber to the electron source.

7 Claims, 7 Drawing Sheets

ION SOURCE HAVING PLASMA CHAMBER, AN ELECTRON SOURCE, AND A PLASMA POWER SUPPLY

BACKGROUND OF THE INVENTION

1. Field of the Invention

The present invention relates to an ion source used for, for example, doping of impurities, synthesis of materials, reformation of a surface, and development of a new material.

2. Description of the Related Art

FIG. 7 is a cross-sectional diagram showing a conventional ion source described in "Ion Source Engineering" written by Junzo Ishikawa and published from Ionics Inc. on May 31, 1986. In FIG. 7, 1 denotes a plasma chamber in which plasma 2 is generated. An opening 3 (hereafter, ion extraction port) is formed as part of the plasma chamber 1 to extract ion from the plasma 2 in the plasma chamber. An extraction electrode 4 is installed outside the plasma chamber and in the vicinity of the ion extraction port 3. An earthed electrode 5 is installed on the opposite side of the plasma chamber 1 relative to the extraction electrode 4. An accelerating power source 6 has a positive terminal connected to the plasma chamber 1 and a negative terminal which is grounded. An extraction power supply 7 has a negative terminal which is connected to the extraction electrode 4 and a positive terminal which is grounded. Then, 8 denotes an ion beam extracted from the plasma 2 in the plasma chamber 1.

Next, the operations of the prior art will be described.

An electric field is produced between the extraction electrode 4, to which a potential which is negative with respect to the one in the plasma chamber 1 is applied, and the plasma chamber 1. Due to the electric field, the ion beam 8 is extracted from the plasma 2 generated in the plasma chamber 1. At this time, positive spatial charges of ions themselves restrict an ion current $I_{si}$(A) of the ion beam 8 extractable from the plasma 2 to a value represented as the expression (1), (refer to page 2 in the aforesaid "Ion Source Engineering")

$$I_{si}=4.3\times10^{-8}\times(2a/d)^2\times M^{-0.5}\times V^{1.5}r \quad (1)$$

In the above expression (1), a represents a radius (cm) of the circular ion extraction port 3, and d represents a space (cm) between the ion extraction port 3 and the extraction electrode 4, V represents a potential difference (extraction voltage) (V) between the ion extraction electrode 4 and the plasma chamber 1, and r represents a coefficient (space charge limit relaxation coefficient) for relaxing limitation of an ion current $I_{si}$ extractable when positive space charges of ions are neutralized with negative space charges of electrons, and assumes any value larger than 1.

An ion current $I_{pi}$ the plasma 2 can supply is represented as the expression (2).

$$I_{pi}=3.0\times10^{-13}\times a^2\times(Te/M)^{0.5}\times ni \quad (2)$$

In the above expression (2), $T_e$ denotes an electron temperature (eV) of the plasma 2, and ni represents a plasma density ($cm^{-3}$).

When $I_{si}=I_{pi}$, the ion beam 8 is extracted optimally from the plasma 2 (refer to page 3 in the aforesaid "Ion Source Engineering").

According to the expression (1), the extraction voltage V is determined by use conditions of an apparatus (20 to 50 kV, in general, when an apparatus is employed for ion implantation). The electrode space d can be reduced merely to a value that does not cause discharge due to the extraction voltage V between the extraction electrode 4 and the plasma chamber 1 (for example, when the extraction voltage V is 40 kV, the extraction electrode space d is about 1 cm.). The ion extraction port 3 must be sized similarly to the electrode space d for optimal ion extraction. Therefore, when space charges of ions are not neutralized with electrons (space charge relaxation coefficient r=1), an extractable ion current $I_{si}$ is restricted by the above requirements. Assuming that the extraction voltage V is 40 kV, the extraction electrode space d is 1 cm, the diameter 2*a* of the ion extraction port 3 is 1 cm, and ionized gas is ionized argon gas (M=40), the above expression (1) is to be calculated. When the space charge limit relaxation coefficient r is 1, a maximum value for the extractable ion current $I_{si}$ is restricted to 54 mA. Therefore, even when plasma 2 from which a sufficiently large ion current $I_{pi}$ can be extracted is generated, if space charges of ions are not neutralized with electrons, an ion current $I_{si}$ of 54 mA or larger cannot be extracted.

To avoid the foregoing limitation of an extractable ion current $I_{si}$, space charges of ions in the vicinity of the ion extraction port 3 must be neutralized with electrons so that the space charge limit relaxation coefficient r in the expression (1) will be larger than 1. A method has been revealed to radiate an electron beam 9 from the extraction electrode 4 toward the ion extraction port 3 as shown in FIG. 8 (refer to page 196 in the aforesaid "Ion Source Engineering"). According to this method, an effect of neutralizing space charges of ions is inversely proportional to the velocity of the radiated electron beam 9. Therefore, a lower velocity results in a greater neutralization effect. In other words, the lower the energy of the electron beam 9 is, the greater the neutralization effect becomes. In reality, however, the electron beam 9 from the ion attraction electrode 4 is accelerated due to an extraction electric field produced with an extraction voltage V induced between the extraction electrode 4 and the plasma chamber 1. Then, the electron beam 9 with high energy is radiated toward the ion extraction port 3. Therefore, space charges of ions are neutralized with space charges of ions ineffectively.

In a conventional ion source, as described above, an electron beam with high energy is radiated from an extraction electrode 4 toward an ion extraction port 3. Therefore, an electron beam 9 to be radiated to the ion extraction port 3 must have a current large enough to neutralize space charges of ions in the vicinity of the ion extraction port 3 and thus extract a large amount of ion current $I_{si}$. However, the radiated electron beam 9 with a large current supplies current to an accelerating power source 6. This increases a load to be imposed on the accelerating power source 6. Furthermore, if the extraction voltage V is, for example, 40 kV, the electron beam 9 with a considerably large current of 100 mA is radiated toward the ion extraction port 3. Then, high power of at least 4 kW flows through the ion source. As a result, the ion source is heated. Unless a cooling mechanism is implemented, the ion source will be fused.

SUMMARY OF THE INVENTION

The present invention attempts to solve the foregoing problems. An object of the invention is to provide an ion source in which an electron beam with low energy is radiated toward an ion extraction port so that the load to an accelerating power supply will be alleviated, and space charges will be optimally neutralized without causing fusion so that a large ion beam will be extracted.

Other object of the present invention is to provide an ion source in which an electron beam with low energy is radiated effectively toward an ion extraction port through a plasma chamber with the dispersion due to its own space charges prevented so that the load to an accelerating power supply will be alleviated, and space charges of ions in the vicinity of the ion extraction port will be optimally neutralized without causing fusion so that a large ion beam will be extracted.

Other object of the present invention is to provide an ion source in which an electron beam with low energy is converged to radiate effectively toward an ion extraction port through a plasma chamber so that the load to an accelerating power supply will be alleviated, and space charges of ions in the vicinity of the ion extraction port will be optimally neutralized without causing fusion so that a large ion beam will be extracted.

Other object of the present invention is to provide an ion source in which an electron beam with low energy is radiated to an ion extraction port through a plasma chamber so that the load to an accelerating power supply will be alleviated, and space charges of ions in the vicinity of the ion extraction port will be optimally neutralized without causing fusion so that a large ion beam will be extracted, and in which the vacuum of the electron source for generating an electron beam remains high to extend a service life of an electron source.

Other object of the present invention is to provide an ion source in which an electron beam with low energy is converged to radiate effectively toward an ion extraction port through a plasma chamber with the dispersion due to its own space charges prevented so that the load to an accelerating power supply will be alleviated, space charges of ions in the vicinity or the ion extraction port will be optimally neutralized without causing fusion, and the vacuum of the electron source for generating an electron beam remains high to extend the service life of the electron source.

An ion source according to the present invention comprises a plasma chamber in which plasma is generated and an ion extraction port is formed to extract an ion beam from the plasma, an electron source for radiating an electron beam toward the ion extraction port through the plasma chamber, and a power supply for controlling a potential difference between the plasma chamber and the electron source.

Other ion source according to the present invention comprises a plasma chamber in which plasma is generated and an ion extraction port is formed to extract an ion beam from the plasma, an electron source for radiating an electron beam toward the ion extraction port through the plasma chamber, an electrode placed between the plasma chamber and the electron source, a first power supply for controlling a first potential difference between the plasma chamber and the electron source, and a second power supply for controlling a second potential difference that occurs between the plasma chamber and the electron source and is larger than the first potential difference.

Other ion source according to the present invention comprises a plasma chamber in which plasma is generated and an ion extraction port is formed to extract an ion beam from the plasma, an electron source for radiating an electron beam toward the ion extraction port through the plasma chamber, an electron lens placed between the plasma chamber and the electron source to converge the electron beam at the vicinity of the ion extraction port, a first power supply for controlling a first potential difference between the plasma chamber and the electron source, and a third power supply for controlling a potential of the electron lens.

Other ion source according to the present invention comprises a plasma chamber in which plasma is generated and an ion extraction port is formed to extract an ion beam from the plasma, an electron source for radiating an electron beam toward the ion extraction port through the plasma chamber, a power supply for controlling a potential difference between the plasma chamber and the electron source, and an aperture placed between the plasma chamber and the electron source to diminish backward flow of air from the plasma chamber toward the electron source.

Other ion source according to the present invention comprises a plasma chamber in which plasma is generated and an ion extraction port is formed to extract an ion beam from the plasma, an electron source for radiating an electron beam toward the ion extraction port through the plasma chamber, a first power supply for controlling a first potential difference between the plasma chamber and the electron source, an electron lens placed between the plasma chamber and the electron source to accelerate the electron beam and to converge the electron beam at the vicinity of the ion extraction port, a fourth power supply for controlling a potential of the electron lens, and an aperture placed between the plasma chamber and the electron source to diminish backward flow of air from the plasma chamber toward the electron source.

In other ion source according to the present invention, the aperture is placed at a crossover point of the electron beam.

In the present invention, due to a potential difference between a plasma chamber and an electron source, an electron beam is extracted from the electron source, then radiated toward an ion extraction port through the plasma chamber. Then, space charges of ions in the vicinity of the ion extraction port are neutralized with space charges of the radiated electron beam. Then, an ion beam is extracted from plasma in the plasma chamber via the ion extraction port.

Alternatively, due to a second potential difference between an electrode placed between a plasma chamber and the electron source, an electron beam is extracted from the electron source, and accelerated and carried. After that, the electron beam is decelerated in the vicinity of the plasma chamber due to a difference between a first potential difference between the plasma chamber and the electron source and the second potential difference, then radiated toward an ion extraction port through the plasma chamber. Then, space charges of ions in the vicinity of the ion extraction port are neutralized with space charges of the electron beam. Finally, an ion beam is extracted from plasma in the plasma chamber via the ion extraction port.

Alternatively, due to a first potential difference between a plasma chamber and an electron source and a potential of an electron lens placed between the plasma chamber and the electron source, an electron beam is extracted from the electron source, converged at the vicinity of an ion extraction port through the plasma chamber, and radiated toward the ion extraction port. After that, space charges of ions in the vicinity of the ion extraction port are neutralized with space charges of the radiated electron beam. Finally, an ion beam is extracted from plasma in the plasma chamber via the ion extraction port.

Alternatively, due to a first potential difference between a plasma chamber and an electron source, an electron beam is extracted from the electron source, and radiated toward an ion extraction port through the plasma chamber. Then, space charges of ions in the vicinity of the ion extraction port are neutralized with space charges of the radiated electron beam. Finally, an ion beam is extracted from plasma in the plasma chamber via the ion extraction port. An aperture placed between the plasma chamber and the electron source diminishes backward flow of air from the plasma chamber to the electron source.

Alternatively, due to a first potential difference between a plasma chamber and an electron source and a potential of an electron lens placed between the plasma chamber and the electron source, an electron beam is extracted from the electron source, and accelerated and carried. After that, the electron beam is decelerated in the vicinity of the plasma chamber due to a difference between the first potential difference and the power supply of the electron lens. Then, the electron beam is converged at the vicinity of the ion extraction port through the plasma chamber, then radiated toward the ion extraction port. Then, space charges of ions in the vicinity of the ion extraction port are neutralized with space charges of the electron beam. Finally, an ion beam is extracted from plasma in the plasma chamber via the ion extraction port. An aperture placed between the plasma chamber and the electron source diminishes backward flow of air from the plasma chamber to the electron source.

Installation of the aperture at a crossover point of an electron beam minimizes backward flow of air from a plasma chamber to an electron source.

DESCRIPTION OF THE PREFERRED EMBODIMENTS

Embodiments of the present invention will be described using an antenna type microwave ion source in which the present invention is implemented.

Embodiment 1

Figure 1:
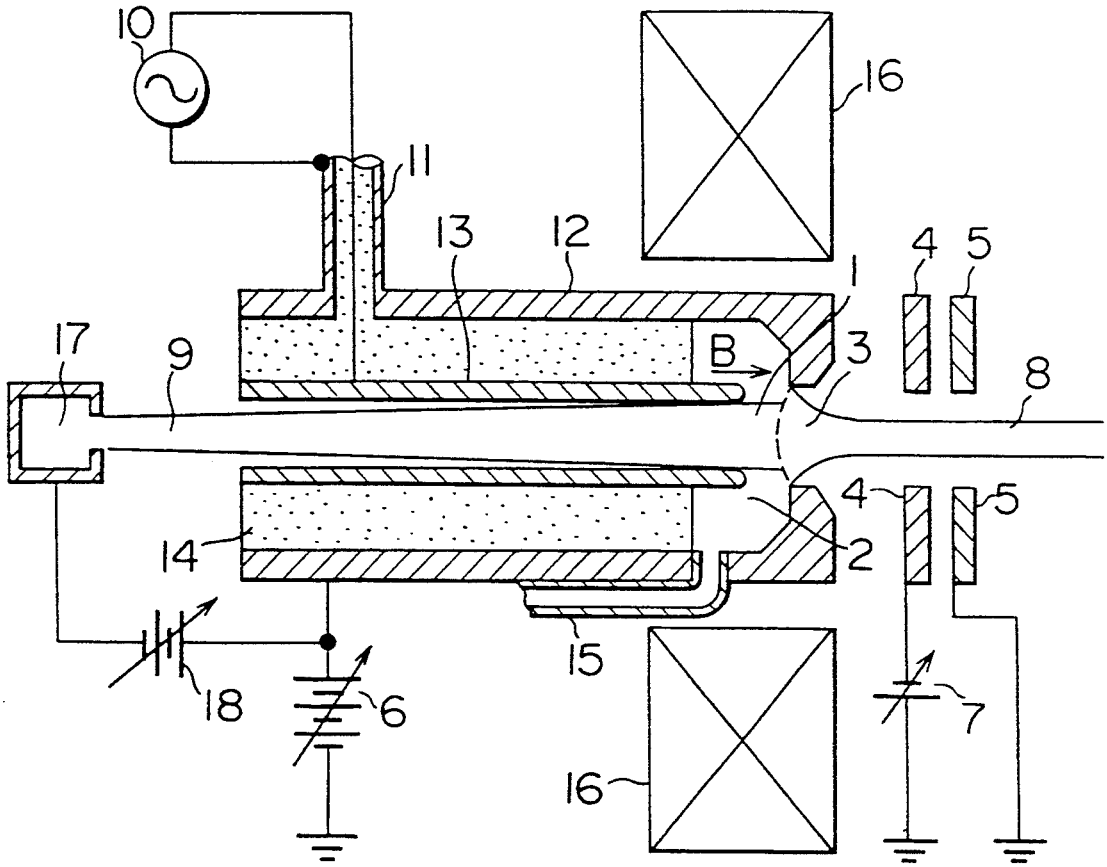
FIG. 1 is a cross-sectional diagram showing the first embodiment of the present invention.

FIG. 1 is a cross-sectional diagram showing the first embodiment of the present invention. In FIG. 1, 1 to 9 denote the same components as those in FIGS. 7 and 8. A microwave source 10 for generating a microwave is connected to a coaxial cable connected to the microwave source. An outer conductor 12 is coupled to the coaxial cable 11 and encapsulates a plasma chamber 1. A hollow antenna 13 is aligned with the center axis of the outer conductor 12. An insulator 14 is inserted into a space between the outer conductor 12 and the antenna 13 other than the plasma chamber 1 inside the outer conductor 12. A gas introduction tube 15 is provided for routing external air (ionized gas) into the plasma chamber 1. A coil 16 is placed in the vicinity of the plasma chamber 1. An electron source 17 is installed outside the outer conductor 12 to radiate an electron beam 9 toward the plasma chamber 1 along the antenna 13. Then, 18 denotes an electron extraction power supply whose positive terminal is connected to a positive terminal of an accelerating power supply 6 and whose negative terminal is connected to the electron source 17.

Next, the operations of the first embodiment of the present invention will be described.

A microwave generated by a microwave source 10 is transmitted into an outer conductor 12 over a coaxial cable 11. Then, a microwave electric field is produced between the inner wall of the outer conductor 12 and an antenna 13. To a plasma chamber 1 which has been deaerated preliminarily to be vacuum, ionized gas is fed from an external unit via a gas introduction tube 15 so that the vacuum will be $10^{01}$ to $10^{-4}$ torr. A flux B is induced in a coil 16 and the microwave electric field react to the ionized gas fed to the plasma chamber 1. This triggers discharge between the outer conductor 12 and the antenna 13. Then, plasma 2 is generated. Then, an extraction voltage between an extraction electrode 4 and the outer conductor 12 is controlled by an accelerating power supply 6 and an extraction power supply 7. With an extraction electric field induced by the extraction voltage between the extraction electrode 4 and the outer conductor 12, an ion beam 8 is extracted from the plasma 2 through the ion extraction electrode 4.

On the other hand, an electron extraction power supply 18 induces a potential difference between the outer conductor 12 and the electron source 17. Due to the potential difference, an electron beam 9 is extracted from the electron source 17. The extracted electron beam 9 is radiated toward an ion extraction port 3 through the antenna 13 and the plasma chamber 1. Thereby, space charges of ions in the vicinity of the ion extraction port 3 are neutralized with space charges of the electron beam 9. Then, the electron beam 9 radiated toward the ion extraction port 3 is reflected from the extraction electric field deriving from a potential difference between the extraction electrode 4 and the outer conductor 12. Then, the reflected electron beam 9 passes through the outer conductor 12 and flows into the electron extraction power supply 18 constituting a closed circuit for the electron source 17.

In the first embodiment, the extraction power supply 18 controls the potential difference between the electron source 17 and the outer conductor 12 so that the potential difference will be lower than an extraction voltage. Therefore, the electron beam 9 to be radiated toward the ion extraction port 3 has lower energy. This prevents fusion of an apparatus. The electron beam 9 radiated toward the ion extraction port 3 does not flow into the accelerating power supply 6. Therefore, no load is imposed on the accelerating power supply 6.

Embodiment 2

Figure 2:
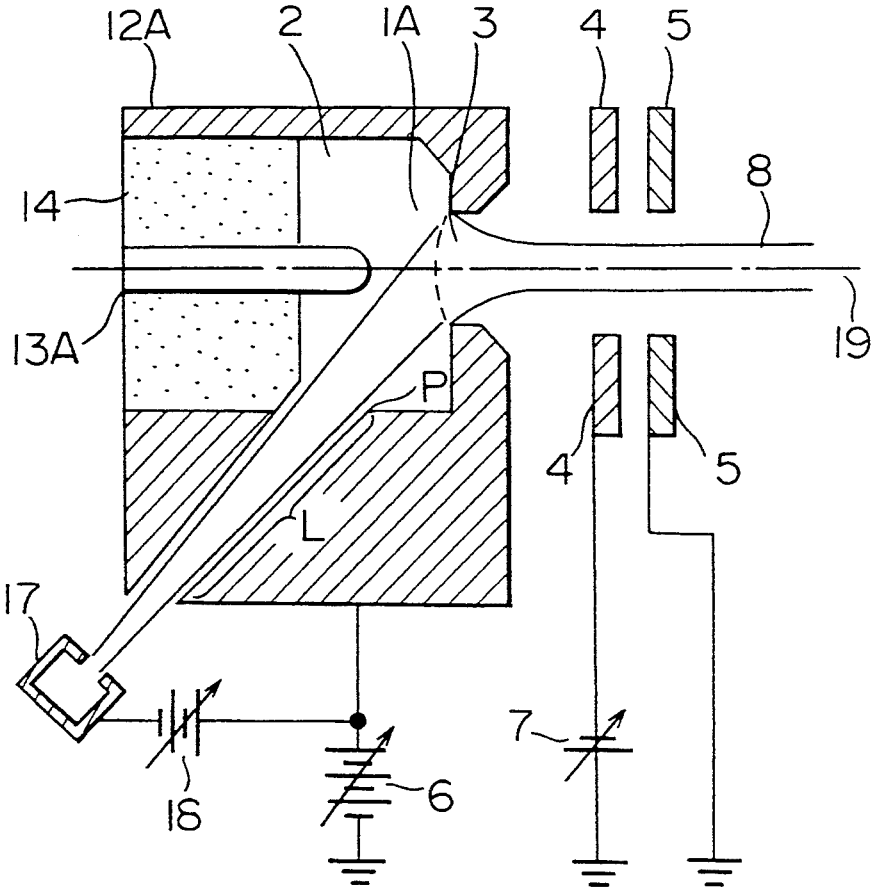
FIG. 2 is a cross-sectional diagram showing the second embodiment of the present invention.

FIG. 2 is a cross-sectional diagram showing the second embodiment of the present invention. In FIG. 2, 2 to 9, 14, 17, and 18 denote the same components as those in FIG. 1. A plasma chamber 1A is provided wherein an opening P for routing an electron beam 9 is formed in a given position such as the bottom. An outer conductor 12A has a path L formed therein through which the electron beam 9 extracted from the electron source 17 is routed to the opening P of the plasma chamber 1A. An antenna 13A is aligned with the center axis 19 of the outer conductor 12A.

In the first embodiment, an electron beam is transmitted along the center axis 19. In this embodiment, however, the electron beam 9 is not transmitted along the center axis 19. More specifically, the electron beam 9 extracted from the electron source 17 is fed to the plasma chamber 1A along the path L of the outer conductor 12A through the opening P of the plasma chamber 1A and radiated toward the ion extraction port 3. Then, space charges of the electron beam 9 causes space charges of ions in the vicinity of the ion extraction port 3 to neutralize. Then, the electron beam 9 radiated toward the ion extraction port 3 is reflected from an extraction electric field between the extraction electrode 4 and the outer conductor 12. Then, the reflected electron beam 9 flows back to the electron extraction power supply 18 through the outer conductor 12.

Thus, this embodiment has the same advantages as the aforesaid first embodiment. Furthermore, since the electron beam 8 does not pass through the antenna 13A, the antenna 13A need not be hollow. This simplifies the structure of the antenna 13A.

Embodiment 3

Figure 3:
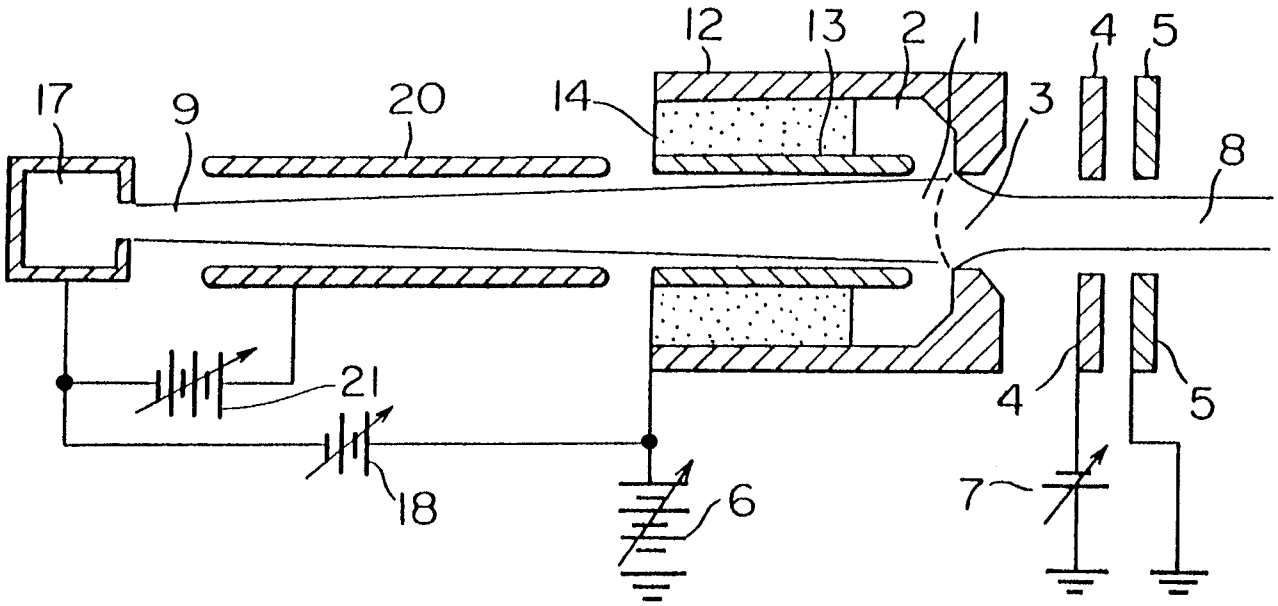
FIG. 3 is a cross-sectional diagram showing the third embodiment of the present invention.

FIG. 3 is a cross-sectional diagram showing the third embodiment of the present invention. In FIG. 3, 1 to 9, 12 to 14, and 17 and 18 denote the same components as those in FIG. 1. An electron accelerating electrode 20 is placed between the electron source 17 and the plasma chamber 1. An electron accelerating power supply 21 serves as a second power supply for controlling a higher potential difference than an electron extraction power supply 18 serving as a first power supply, wherein the positive terminal is connected to the electron accelerating electrode 20 and the negative terminal is connected to a negative terminal of the electron extraction power supply 18.

The electron accelerating power supply 21 induces a potential difference between the electron accelerating electrode 20 and the electron source 17. Due to the potential difference, the electron beam 9 is extracted from the electron source 17. Then, the electron beam 9 is accelerated, and carried through the electron accelerating electrode 20 at a high speed, then fed to the antenna 13. After that, the electron beam 9 is decelerated due to a potential difference between the outer conductor 12 and the electron accelerating electrode 20, then radiated toward the ion extraction port 3. Then, the electron beam 9 causes space charges of ions in the vicinity of the ion extraction port 3 to neutralize, Then, part of the electron beam 9 extracted from the electron source 17 flows through the electron accelerating power supply 21. The remaining portion of the electron beam 9 is radiated toward the ion extraction port 3, then reflected from an extraction electric field between the extraction electrode 4 and the outer conductor 12 to flow into the electron extraction power supply 18 through the outer conductor 12.

Thus, this embodiment has the same advantages as the first embodiment. Furthermore, since the electron beam 9 is carried from the electron source 17 to the vicinity of the plasma chamber at a high speed, the electron beam 9 is prevented from dispersing due to its own space charges. Moreover, since the electron beam 9 decelerates in the vicinity of the plasma chamber 1, space charges of the electron beam 9 are neutralized with space charges of ions. This prevents dispersion after deceleration. Consequently, the electron beam 9 is radiated effectively toward the ion extraction port 3.

Embodiment 4

Figure 4:
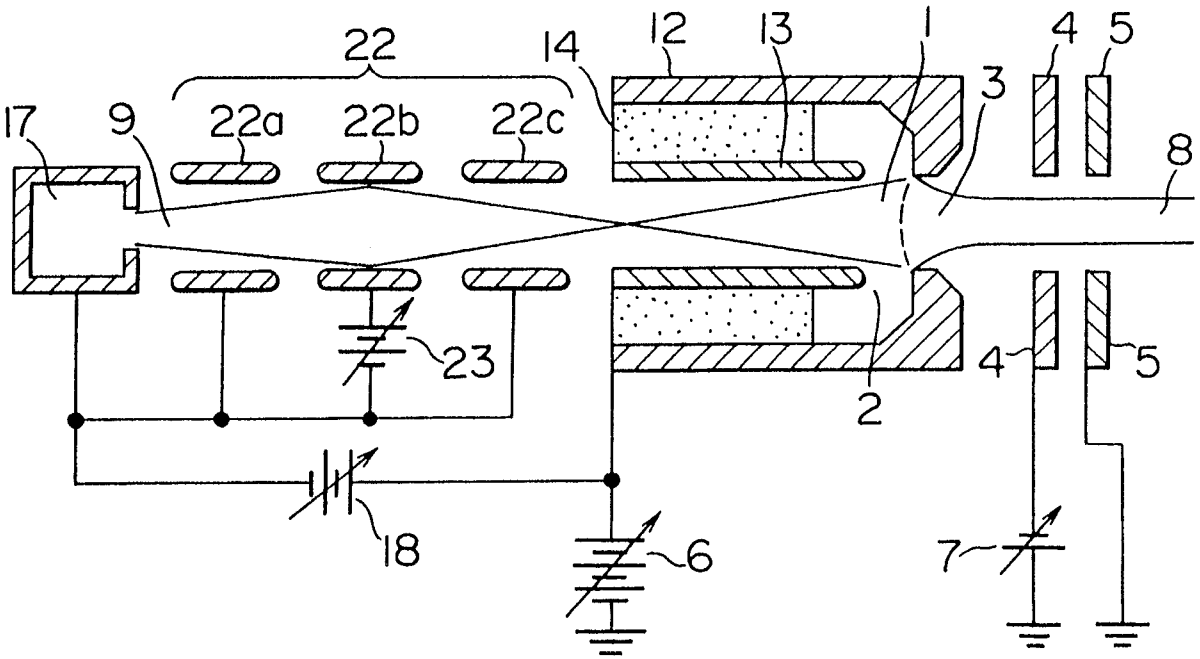
FIG. 4 is a cross-sectional diagram showing the fourth embodiment of the present invention.

FIG. 4 is a cross-sectional diagram showing the fourth embodiment of the present invention. In FIG. 4, 1 to 9, 12 to 14, and 17 and 18 denote the same components as those in FIG. 1. An electron lens 22 is placed between the electron source 17 and the plasma chamber 1, which is, for example, an electric field lens made up of lens electrodes **22*a* to 22*c*. A lens power supply 23 serves as a third power supply, wherein the positive terminal is connected to the lens electrode 22*b* and the negative terminal is connected to the negative terminal of the electron extraction power supply 18 serving as a first power supply and to the lens electrodes 22*a* and 22*c*. The electric field lens 22 functions in acceleration mode because the lens power source 23 is connected to have such a polarity as shown in FIG. 4**.

The electron extraction power supply 18 induces a potential difference between the lens electrodes **22*a* and 22*c* and the electron source 17. Due to the potential difference, the electron beam 9 is extracted from the electron source 17. The lens power supply 23 controls potential differences between the lens electrode 22*b* and the lens electrodes 22*a* and 22*c*. Then, the electron beam 9 extracted from the electron source 17 is converged to radiate toward the ion extraction port 3. Thereby, space charges of ions in the vicinity of the ion extraction port 3 are neutralized with space charges of the electron beam 9. The radiated electron beam 9 flows into the electron extraction power supply 18 through the outer conductor 12. In general, the lens power supply 23 controls potential differences between the lens electrode 2*b* and the lens electrode 22*a* and 22*c*, so that the ion current of the ion beam 8 will be maximized and the current flowing into the extraction electrode 4** will be minimized.

Thus, this embodiment has the same advantages as the first embodiment. Furthermore, since the electron beam 9 converges in the vicinity of the ion extraction port 3, the electron beam 9 is radiated effectively toward the ion extraction port.

Embodiment 5

Figure 5:
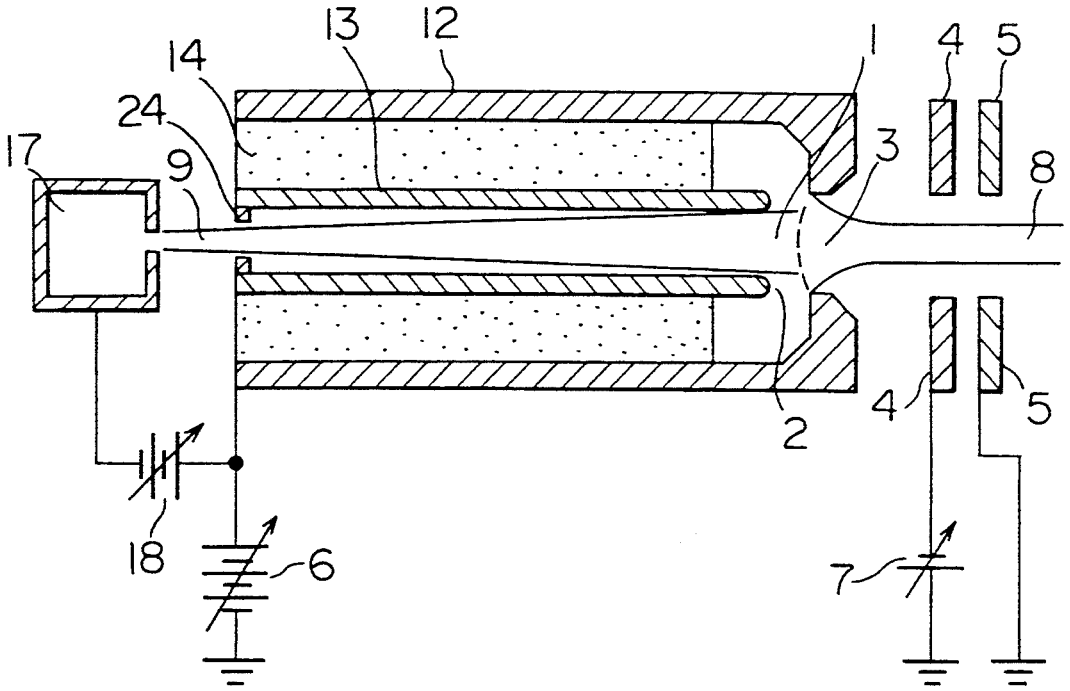
FIG. 5 is a cross-sectional diagram showing the fifth embodiment of the present invention.

FIG. 5 is a cross-sectional diagram showing the fifth embodiment of the present invention. In FIG. 5, 1 to 9, 12 to 14, and 17 and 18 denote the same components as those in FIG. 1. An aperture 24 is inserted into the path of the electron beam 9 radiated toward the ion extraction port 3 formed by, for example, the antenna 13. The aperture 24 forms an opening that enables the electron beam 9 to pass through.

Assuming that a filament is employed as the electron source 17, the vacuum of the filament during normal operation should, preferably, be $10^{-4}$ torr or less. In general, the plasma chamber 1 is used with a vacuum ranging from $10^{-2}$ to $10^{-4}$ torr. Therefore, when ionized gas flows from the plasma chamber 1 back to the electron source 17, the filament deteriorates due to spatter and shortens its service life. In this embodiment, since the aperture 24 is installed, a conductance between the plasma chamber 1 and the electron source 17 is reduced to diminish backward flow of ionized gas from the plasma chamber 1 to the electron source 17.

Thus, this embodiment has the same advantages as the first embodiment. Furthermore, since backward flow of ionized gas from the plasma chamber 1 to the electron source 17 diminishes, the vacuum of the electron source 17 remains high. This extends the service life of the electron source 17.

Embodiment 6

Figure 6:
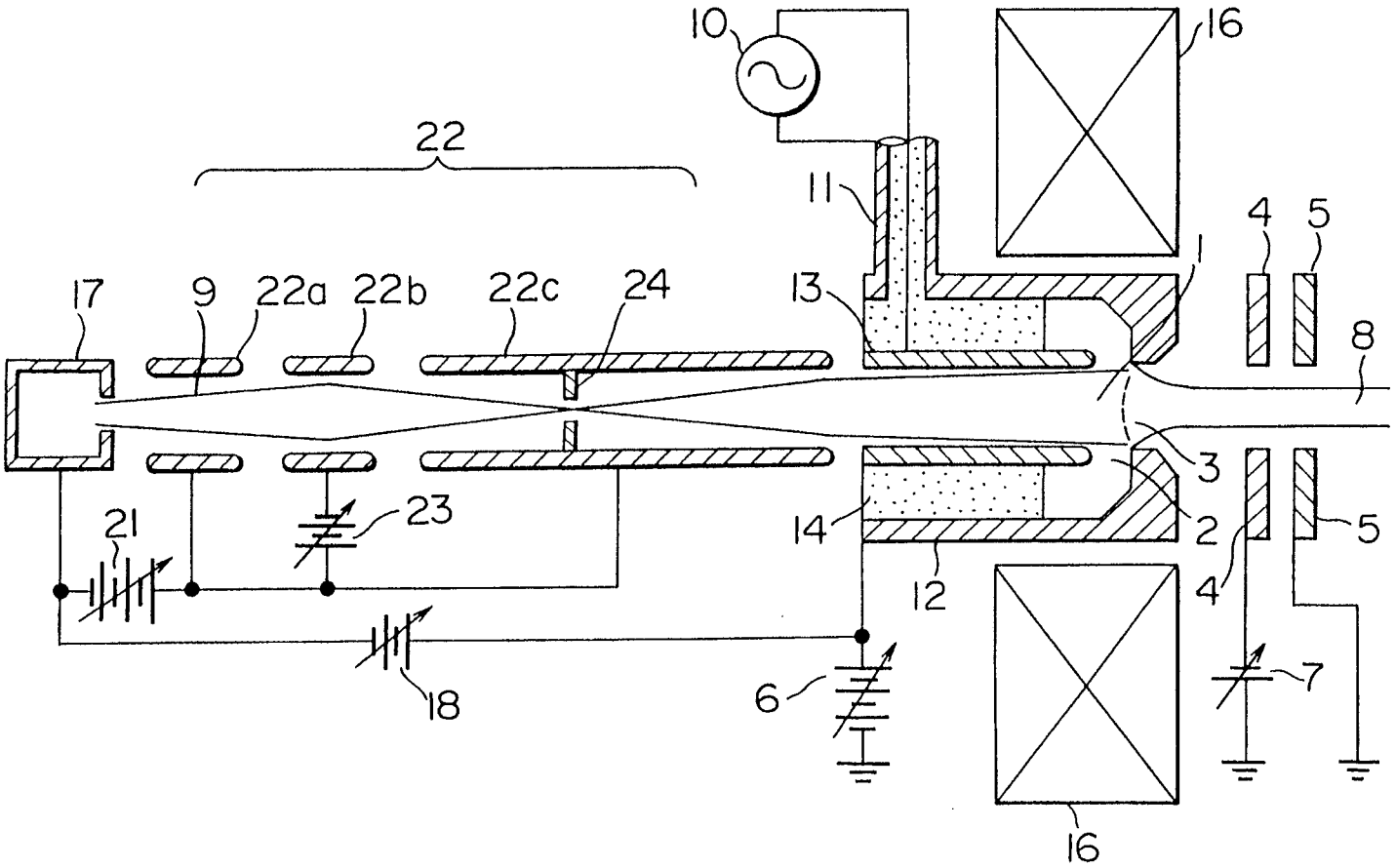
FIG. 6 is a cross-sectional diagram showing the sixth embodiment of the present invention.
Figure 7:
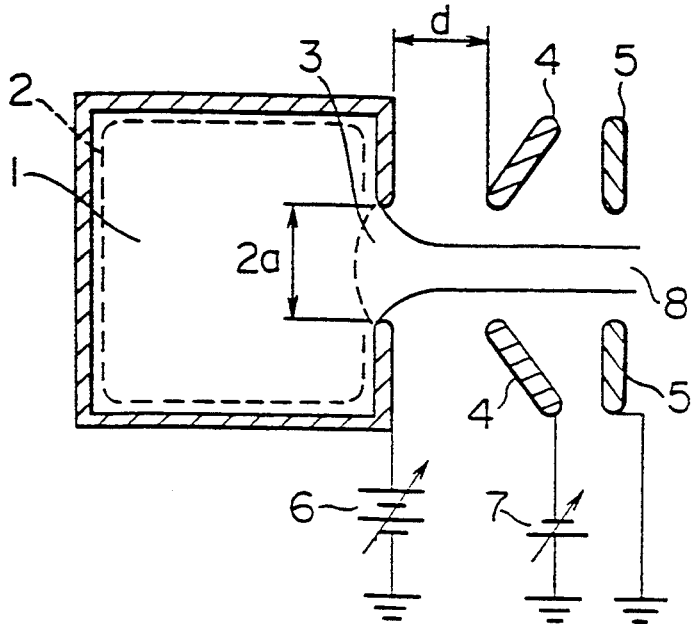
FIG. 7 (PRIOR ART)
FIG. 7 is a cross-sectional diagram showing a conventional ion source.
Figure 8:
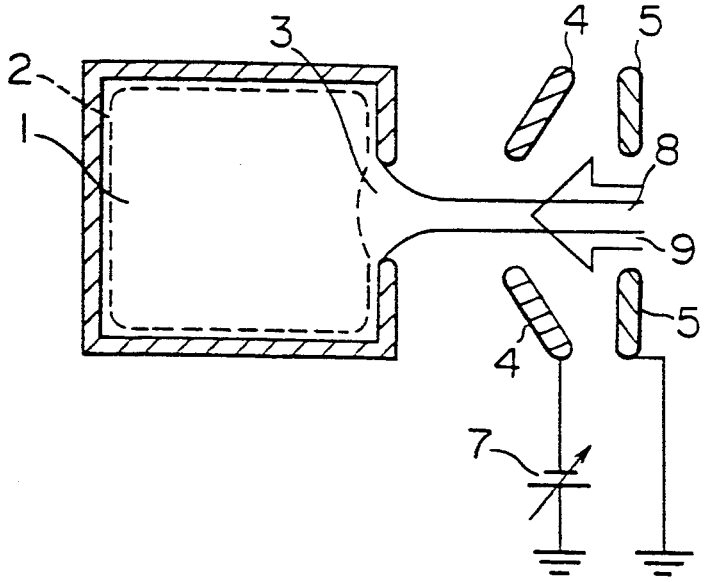
FIG. 8 (PRIOR ART)
FIG. 8 is a cross-sectional diagram showing an incident electron beam in a conventional ion source.

FIG. 6 is a cross-sectional diagram showing the sixth embodiment of the present invention, wherein the first, and third to sixth embodiments are integrated. In FIG. 6, 1 to 9, 10 to 14, 16 to 18, and 21 to 23 denote the same components as those shown in FIGS. 1, and 3 to 5. The aperture 24 is installed at a crossover point of the electron beam 9 (inside the electrode 22*c* in this embodiment). The electric field lens 22 functions in deceleration mode because the lens power supply 23 is connected to have a polarity as shown in FIG. 6. The first power supply is the electron extraction power supply 18. The fourth power supply is made up of the electron accelerating power supply 21 and the lens power supply 23.

Thus, this embodiment has the same advantages as the first, and third to fifth embodiments. Furthermore, since acceleration and convergence of the electron beam 9 are controllable using the electric field lens 22, electron accelerating power supply 21, and lens power supply 23, an entire apparatus can be designed compactly. Moreover, since the diameter of the electron beam 9 is minimized at the crossover point of the electron beam 9, the aperture 24 has a minimum diameter at the crossover point. Therefore, backward flow of air from the plasma chamber 1 to the electron source 17 can be minimized and the vacuum of the electron source 17 can be held high. This maximizes the service life of the electron source 17.

Embodiment 7

In the embodiments 1 to 7, space charges are neutralized by installing an electron source in an antenna type microwave ion source. The present invention has the same advantages even when implemented in a wave guide type microwave ion source, a freeman type ion source, a PIG type ion source, and ion sources of other types.

Embodiment 8

In the fourth embodiment, an electric field lens made up of three electrodes is employed. Adoption of other electric field lens will provide the same advantages.

Embodiment 9

In the fourth embodiment, an electric field lens is employed. Adoption of a magnetic field lens will provide the same advantages.

Embodiment 10

In the sixth embodiment, an electric field lens made up of three electrodes is employed. Combined use of other electric field lenses will provide the same advantages.

The present invention, as described so far, comprises a plasma chamber in which plasma is generated and an ion extraction port is formed to extract an ion beam from the plasma, an electron source for radiating an electron beam toward the ion extraction port through the plasma chamber, and a power supply for controlling a potential difference between the plasma chamber and the electron source. Thereby, an electron beam with low energy is radiated toward the ion extraction port through the plasma chamber. This alleviates the load to an accelerating power supply. Furthermore, space charges are neutralized optimally without causing fusion. As a result, a large ion beam is extracted.

Alternatively, the present invention comprises a plasma chamber in which plasma is generated and an ion extraction port is formed to extract an ion beam from the plasma, an electron source for radiating an electron beam toward the ion extraction port through the plasma chamber, an electrode placed between the plasma chamber and the electron source, a first power supply for controlling a first potential difference between the plasma chamber and the electron source, and a second power supply for controlling a second potential difference that is induced between the electrode and the electron source and larger than the first potential difference. Thereby, an electron beam with low energy is radiated effectively toward the ion extraction port through the plasma chamber while being prevented from dispersing due to its own space charge. This alleviates the load to an accelerating power supply. Furthermore, space charges of ions in the vicinity of the ion extraction port are neutralized optimally without causing fusion. As a result, a large ion beam is extracted.

Alternatively, the present invention comprises a plasma chamber in which plasma is generated and an ion extraction port is formed to extract an ion beam from the plasma, an electron source for radiating an electron beam toward the ion extraction port through the plasma chamber, an electron lens placed between the plasma chamber and the electron source to converge the electron beam in the vicinity of the ion extraction port, a first power supply for controlling a first potential difference between the plasma chamber and the electron source, and a third power supply for controlling the potential of the electron lens. Thereby, an electron beam with low energy is converged to radiate effectively toward the ion extraction port through the plasma chamber. This alleviates the load to an accelerating power supply. Furthermore, space charges of ions in the vicinity of the ion extraction port are neutralized optimally without causing fusion. As a result, a large ion beam is extracted.

Alternatively, the present invention comprises a plasma chamber in which plasma is generated and an ion extraction port is formed to extract an ion beam from the plasma, an electron source for radiating an electron beam toward the ion extraction port through the plasma chamber, a power supply for controlling a potential difference between the plasma chamber and the electron source, and an aperture placed between the plasma chamber and the electron source to diminish backward flow of air from the plasma chamber to the electron source. Thereby, an electron beam with low energy is radiated toward the ion extraction port through the plasma chamber. This alleviates the load to an accelerating power supply. Furthermore, space charges of ions in the vicinity of the ion extraction port are neutralized optimally without causing fusion. As a result, a large ion beam is extracted. Moreover, since the vacuum of the electron source for generating an electron beam remains high, the service life of the electron source lasts longer.

Alternatively, the present invention comprises a plasma chamber in which plasma is generated and an ion extraction port is formed to extract an ion beam from the plasma, an electron source for radiating an electron beam toward the ion extraction port through the plasma chamber, a first power supply for controlling a first potential difference between the plasma chamber and the electron source, an electron lens placed between the plasma chamber and the electron source to accelerate the electron beam and converge the electron beam in the vicinity of the ion extraction port, a fourth power supply for controlling the potential of the electron lens, and an aperture placed between the plasma chamber and the electron source to diminish backward flow of air from the plasma chamber to the electron source. Thereby, an electron beam with low energy is radiated effectively toward the ion extraction port through the plasma chamber while being prevented from dispersing due to its own space charge. This alleviates the load to an accelerating power supply. Furthermore, space charges of ions in the vicinity of the ion extraction port are neutralized optimally without causing fusion. Moreover, since the vacuum of the electron source for generating an electron beam remains high, the service life of the electron source lasts longer.

Alternatively, the aperture is installed at a crossover point of an electron beam. This maximizes the vacuum of the electron source. Consequently, the service life of the power supply lasts further longer.

What is claimed is:

1. An ion source, comprising:

a plasma chamber in which plasma is generated and an ion extraction port is formed to extract an ion beam from the plasma;

an electron source for radiating an electron beam toward the ion extraction port through the plasma chamber; and an electron extraction power supply connected between said plasma chamber and said electron source to induce a potential difference therebetween, wherein the electrical potential induced by the electron extraction power supply has a magnitude intensity which causes an energy level of the electron beam to moderate space charges around the ion extraction port.

2. An ion source according to claim 1 further comprising, an electrode placed between said plasma chamber and said electron source and an accelerating power supply inducing a potential difference between said electrode and said electron source.

3. An ion source according to claim 1 further comprising, an electron lens placed between said plasma chamber and said electron source to converge said electron beam at the vicinity of said ion extraction port.

4. An ion source according to claim 1, further comprising an electron lens placed between said plasma chamber and said electron source to diminish backward flow of air from said plasma chamber to said electron source.

5. An ion source according to claim 1, further comprising an electron lens placed between said plasma chamber and said electron source to converge said electron beam at the vicinity of said ion extraction port and an aperture for diminishing backward flow of air from said plasma chamber to said electron source.

6. An ion source according to claim 5, wherein said aperture is installed at a crossover point of said electron beam.

7. An ion source according to claim 1, wherein said electron source is arranged so that said electron beam will be radiated to the vicinity of said ion extraction port with a given angle relative to said ion beam.

* * * * *